US007420883B2

(12) United States Patent
Claret et al.

(10) Patent No.: US 7,420,883 B2
(45) Date of Patent: Sep. 2, 2008

(54) ANIMATED TIMEPIECE

(75) Inventors: Christophe Claret, Chez-le-Bart (CH); Jan Dubois, La Chaux-de-Fonds (CH); Pierre Koukjian, Madrid (ES)

(73) Assignee: Christophe Claret S.A., Le Locle (CH)

( * ) Notice: Subject to any disclaimer, the term of this patent is extended or adjusted under 35 U.S.C. 154(b) by 0 days.

(21) Appl. No.: 11/720,544

(22) PCT Filed: Dec. 5, 2005

(86) PCT No.: PCT/EP2005/056480

§ 371 (c)(1),
(2), (4) Date: May 31, 2007

(87) PCT Pub. No.: WO2006/058925

PCT Pub. Date: Jun. 8, 2006

(65) Prior Publication Data

US 2008/0106978 A1 May 8, 2008

(30) Foreign Application Priority Data

Dec. 3, 2004 (CH) ..... 2004/04

(51) Int. Cl.
*G04B 19/00* (2006.01)
*G04B 19/02* (2006.01)
*G04B 19/26* (2006.01)

(52) U.S. Cl. ..... 368/76; 368/18; 368/221

(58) Field of Classification Search ..... 368/16, 368/18, 37, 38, 76, 220–221, 223, 228, 229
See application file for complete search history.

(56) References Cited

U.S. PATENT DOCUMENTS 2,591,876 A 4/1952 Fritz-Andre'
2,643,506 A 6/1953 Rodanet (Continued)

FOREIGN PATENT DOCUMENTS

CH 198192 6/1938

(Continued)

OTHER PUBLICATIONS

Automated English Translation (Abstract Only) of above Foreign Patent (E) No. EP 1 321 832 A1 as obtained from website http://www.espacenet.com (English translation was readily available of Abstract only).

(Continued)

*Primary Examiner*—Vit W Miska
(74) *Attorney, Agent, or Firm*—Townsend M. Belser, Jr.; Nexsen Pruet, LLC

(57) ABSTRACT

A timepiece movement is disclosed which may comprise a going train, and a mechanism having a first cinematic connection with the going train and arranged to drive an indicator member in a stealthy rotational movement, the latter being activated periodically with a predefined period. The mechanism may also comprise a first wheel-and-pinion unit comprising a first wheel at least indirectly in engagement with the going train, a second wheel-and-pinion unit, mounted coaxially with the first wheel-and-pinion unit and, having at least one stop region and a second wheel, these being integral in rotation. A second cinematic connection connects the second wheel to the indicator member, an elastic member connecting the first wheel-and-pinion unit to the second wheel-and-pinion unit in such a way that its degree of tension is a function of respective angular positions of the first and second wheel-and-pinion units. The mechanism may further comprise locking means designed to prevent the second wheel-and-pinion unit from rotating between two successive movements of the indicator member, as well as release means designed to act on the locking means, in each period, in order to release them momentarily and permit stealthy rotation of the second wheel-and-pinion unit through a predefined angle The mechanism may also comprise a retarding device acting on the second wheel-and-pinion unit in such a way as to limit its speed of stealthy rotation.

20 Claims, 1 Drawing Sheet

U.S. PATENT DOCUMENTS

| | | | | | |
|---|---|---|---|---|---|
| 3,352,103 | A | | 11/1967 | Giger | |
| 3,744,237 | A | * | 7/1973 | Muto | 368/76 |
| 3,871,171 | A | | 3/1975 | Charbonney et al. | |
| 3,893,289 | A | * | 7/1975 | Giger et al. | 368/38 |
| 4,063,411 | A | * | 12/1977 | Murrle | 368/221 |
| 5,384,755 | A | * | 1/1995 | Ferenczy | 368/35 |

FOREIGN PATENT DOCUMENTS

| | | | |
|---|---|---|---|
| CH | 351543 | | 2/1961 |
| EP | 1 321 832 | A1 | 6/2003 |
| EP | 1 372 047 | A1 | 12/2003 |
| FR | 2.180.645 | | 11/1973 |
| FR | 2 241 815 | | 3/1975 |

OTHER PUBLICATIONS

Automated English Translation (Abstract Only) of above Foreign Patent (H) No. EP1372047A1 as obtained from website http://www.espacenet.com (English translation was readily available of Abstract only).

International Search Report PCT/EP2005/056480 related to subject application.

Swiss Search Report related to subject application.

* cited by examiner

ANIMATED TIMEPIECE

BACKGROUND OF THE INVENTION

1. Field of the Invention

The field of this disclosure is horology. It relates more particularly to a timepiece movement comprising a mechanism arranged to drive an indicator member in a stealthy rotational movement activated periodically, with a predefined period.

In this text, the use of the term "stealthy" in relation to the notion of period should be understood to relate to an event whose duration is much shorter than this period. A non-restrictive example would be that the rotational movement is activated once every minute and each activation lasts for three seconds.

More precisely, the horological movement comprises a going train, the mechanism also comprising

- a first wheel-and-pinion unit comprising a first wheel at least indirectly in engagement with the going train,
- a second wheel-and-pinion unit mounted coaxially with the first wheel-and-pinion unit, having at least one stop region and a second wheel, these being integral in rotation, while a second cinematic connection connects the second wheel to the indicator member,
- an elastic member connecting the first wheel-and-pinion unit to the second wheel-and-pinion unit in such a way that its degree of tension is a function of the respective angular positions of the first and second wheel-and-pinion units, and
- locking means designed to engage with the stop region of the second wheel-and-pinion unit to prevent the latter from rotating between two successive movements of the indicator member.

In a preferred exemplary embodiment of the invention, the indicator member may carry a sign, which may or may not represent time information of some kind, this sign being made visible to a user through an opening in the dial of the corresponding timepiece, but only during at least part of the stealthy rotational movement.

2. Description of Related Art

Numerous jumping mechanisms are known in the prior art, particularly in movements for driving one or other of the time-indicating members in a jumping or intermittent manner. For instance, numerous movements of the so-called "dead seconds" type are known in which the seconds indicator member is driven in jumps occurring at a lower frequency than that of the time base of the movement, typically an escapement. U.S. Pat. No. 2,591,876 discloses one embodiment of a movement of this type.

These mechanisms usually employ two wheels, one driven continuously by the going train, and the other intermittently only, by the relaxing of an elastic member which is tensioned between two successive jumps, by the continuous rotation of the first wheel. Locking means similar to an escapement anchor are conventionally used to hold back the second wheel between two movements, by interaction with its teeth.

However, these mechanisms sometimes take up a great deal of space, are often sensitive to shocks, and can transmit only very sudden movements to the intermittently driven indicator member.

SUMMARY OF THE INVENTION

The principal object of the present invention is to provide a space-saving and reliable alternative to the known mechanisms of the prior art.

Another object of the present invention is to display information stealthily, at a speed such as to ensure its visibility.

To this end, the invention relates to a horological movement of the type indicated above, in which the first wheel-and-pinion unit may comprise a cam coaxial with and fixed to the first wheel and designed to act on the locking means, in each period, in order to release them momentarily and permit stealthy rotation of the second wheel-and-pinion unit through a predefined angle, under the action of the elastic member.

The mechanism may further comprise a retarding device acting on the second wheel-and-pinion unit in such a way as to limit its speed of stealthy rotation.

By means of these particular features, the horological movement may be of any known type and have any known level of complication, and yet its mechanism for the intermittent driving of an indicator member imposes no great constraints on its manufacturer.

Moreover, the fact that a retarder may act on the second wheel-and-pinion unit makes it possible to limit the speed of movement of a sign carried by the indicator member, thus improving its visibility to the wearer of the corresponding timepiece. It is thus possible with the movement according to the present invention to make such a sign visible in a stealthy manner, whereas this is not possible with the prior-art mechanisms, the object of which is to replace one sign with another in the shortest possible time, and in which the movements of these signs are too fast to meet the purpose described above.

In a preferred embodiment, the second wheel-and-pinion unit may comprise a drive wheel, the stop region being formed in its periphery in the form of a notch. In addition, the locking means may comprise one, preferably two, long springs having a free end designed to engage in this notch to prevent the drive wheel from rotating.

In addition, the general shape of the cam may preferably be that of a disk of a predefined radius, shorter than a radius of activation, defined between the axis of rotation of the second wheel-and-pinion unit and the bottom of the notch, the cam also comprising a nose situated at a distance from the axis of rotation greater than the radius of activation and designed to push away the free end of the long spring or springs in each period.

In this form, at every instant of operation of the mechanism, at least one of the respective free ends of the long springs may be bearing against the periphery of the drive wheel, thus acting as a retarder.

In a preferred embodiment, the indicator member may be made of a transparent material and carries a sign representing a shooting star that may be superimposed on a disk indicating the phases of the moon. By means of these particular features, the horological movement may provide the wearer of this watch with an exclusive animation, by the superimposition on a display member of time information.

The present invention also relates to a timepiece in which such a movement is employed.

BRIEF DESCRIPTION OF THE DRAWING

Other features and advantages of the invention will become more clearly apparent on reading the following detailed description, which refers to the attached FIG. 1, presented by way of a non-restrictive example showing a schematic top view of a preferred embodiment of part of the movement according to the present invention, specifically the mechanism for transmitting a periodic stealthy rotational movement to an indicator member.

DETAILED DESCRIPTION OF THE INVENTION

Figure 1:
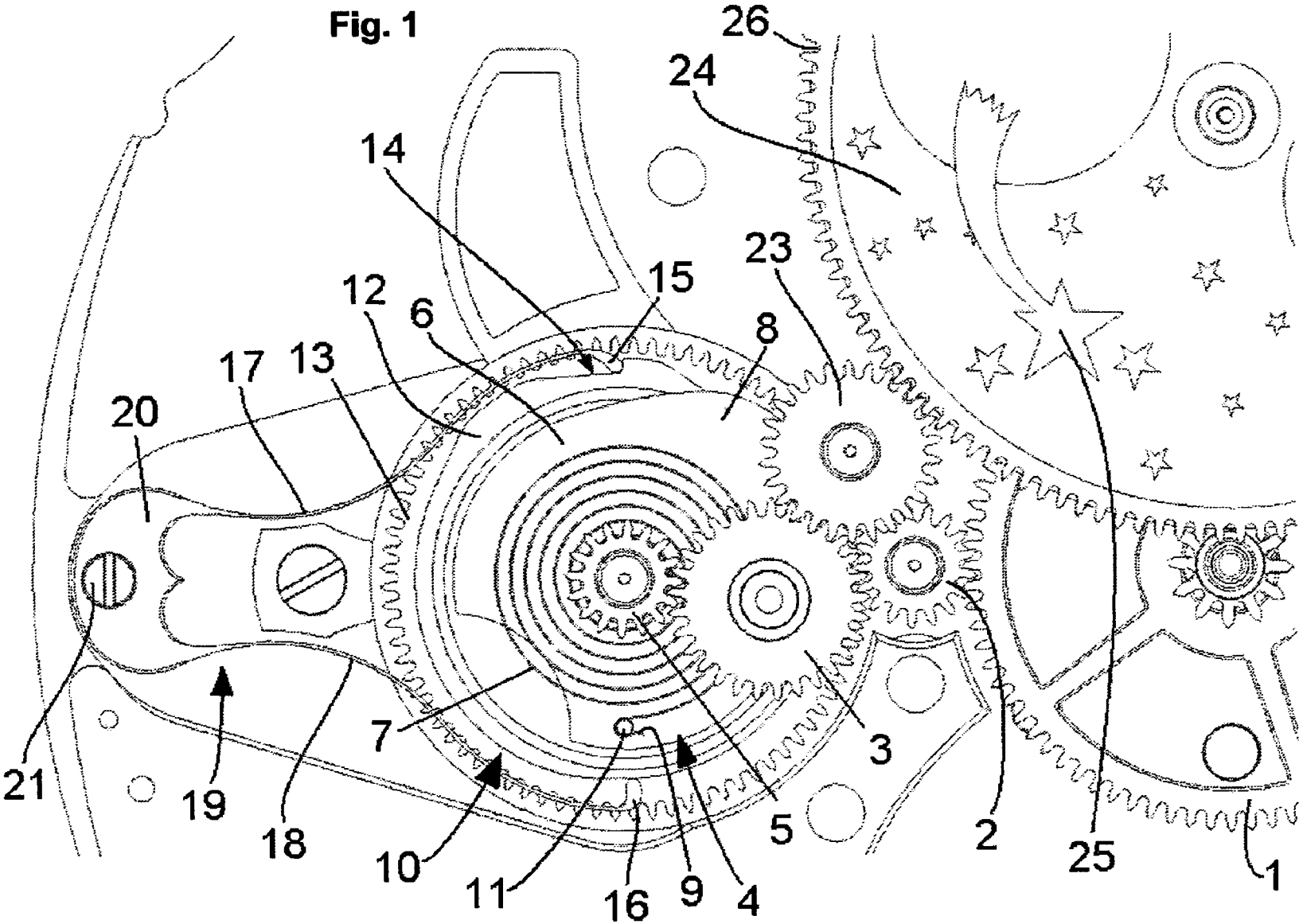

FIG. 1 shows part of a center wheel 1 driven in a clockwise direction and engaging, via two intermediate gears 2 and 3, with a first wheel-and-pinion unit 4.

The first wheel-and-pinion unit comprises a pinion 5 connected coaxially to a cam 6, and carries a first end (not visible) of a spiral spring 7. The general shape of the cam is a disk, of predefined radius, part of its periphery being extended to define a nose 8. In the central region of its nose, therefore, the radius of the cam is greater than its average radius.

The other end 9 of the spiral spring is fixed to a second wheel-and-pinion unit 10 mounted coaxially with the first wheel-and-pinion unit. More precisely, the end 9 is secured to a pin 11 carried by a drive wheel 12 of this second wheel-and-pinion unit. The latter also comprises a lower wheel 13 coaxial with and secured to the drive wheel 12.

The drive wheel has a notch 14 designed to receive in alternation the diametrically opposed free ends 15 and 16 of two arms 17, 18 of a long U-shaped double spring 19. Both arms 17 and 18 extend away from a common base 20 which is fixed to part of the frame of the movement by a screw 21.

As a result, the long springs perform a locking function by engaging with the notch which defines a stop region where the drive wheel is arrested.

The rotation of the pinion 5 in the counterclockwise direction has the effect of winding up the spiral spring 7 until the nose 8 of the cam 6 meets and lifts the free end 15 of the first arm 17 of the spring 19. The drive wheel 12 is thereby released and, under the action of the spiral spring 7, is rapidly driven through 180° counterclockwise until the free end 16 of the second arm 18 of the spring 19 drops into its notch 14 and immobilizes it. The speed of rotation of the drive wheel is determined by the force of the spiral spring 7 and by its angle of prewinding.

If a radius of activation is defined as corresponding to the distance between the center of the cam and the bottom of the notch, it is a simple matter to ensure that the radius of the cam in its nose region is greater than this activation radius in order to ensure that the nose can lift the free ends of the arms 17, 18.

During this half-revolution, the drive wheel 12 is turning the lower wheel 13. The latter meshes with the pinion (not visible) of a wheel-and-pinion unit whose wheel 23 in turn meshes with the outer teeth of an indicator member comprising a wheel 24, or toothed disk, to which a metallization 25 has been applied representing a shooting star. The mechanism is designed so that this half revolution of the wheel 23 will turn the metallization through one complete revolution in the counterclockwise direction.

As the pinion 5 continues to rotate, the same process will be repeated periodically, the roles of the free ends 15, 16 of the arms 17 and 18 reversing on each occasion.

The gearing ratio of the system can be determined in such a way that the rapid movement of the shooting star occurs once every six minutes for example.

In an advantageous embodiment, the disk 24 bearing the shooting star 25 is made of sapphire and is positioned in front of the disk 26 of a mechanism for displaying the phases of the moon, which is well known to those skilled in the art. The rest position of the star is of course hidden beneath the dial.

The above description is intended to describe particular embodiments by way of non-restrictive illustration, the invention not being limited, for example, to the shape or number of springs 17, 18 that lock the drive wheel. As an example, a single such spring may be used, or two mutually independent springs may be fixed to the frame element of the movement.

It will be clear from the foregoing that besides fulfilling the function of locking the drive wheel, the long arms or springs 17, 18 also act as a retarding device on the drive wheel when the drive wheel is released to perform a half revolution. The shaping (shown by way of non-restrictive example) of the free ends 15, 16 is thus particularly adapted both to stopping the drive wheel and applying a predefined frictional force to regulate its speed of rotation when it is released. The reasoning behind this is that it is clear that, advantageously, at every instant of operation of the movement illustrated, at least one of the two free ends 15 and 16 is pressing on the periphery of the drive wheel. In addition, the arrangement of the free ends 15, 16 such that they are approximately diametrically opposed about the drive wheel 12 minimizes the stresses on the wheel 12, notably at its pivot. This particular feature helps to improve the durability of the mechanism of the present invention.

Alternatively, a supplementary leaf spring could for example be fitted in such a way as to be in permanent contact with the periphery of the drive wheel. Again, a person skilled in the art will be able to adapt the shape of the periphery of the drive wheel to his or her particular requirements, without departing from the scope of the present invention. If this periphery is given an irregular shape, the speed of rotation of the drive wheel can be made to vary through the course of a particular stealthy rotational movement.

By means of these features the speed of movement of the shooting star behind a window in the dial of the corresponding timepiece can be adjusted to make it move stealthily while being clearly visible to the person wearing the timepiece.

Again, the elastic member providing the connection between the first and second wheel-and-pinion units may be of some other shape than a spiral spring, without departing from the scope of the invention. Likewise the gearing ratios and time values mentioned above are not restrictive and may be varied as desired.

What is claimed is:

1. A timepiece movement comprising a going train, and a mechanism having a first cinematic connection with said going train and arranged to drive an indicator member in a stealthy rotational movement, said movement being activated periodically, with a predefined period, said mechanism also comprising a first wheel-and-pinion unit comprising a first wheel at least indirectly in engagement with said going train, a second wheel-and-pinion unit mounted coaxially with said first wheel-and-pinion unit, having at least one stop region and a second wheel, these being integral in rotation, while a second cinematic connection connects said second wheel to said indicator member, an elastic member connecting said first wheel-and-pinion unit to said second wheel-and-pinion unit in such a way that its degree of tension is a function of respective angular positions of said first and second wheel-and-pinion units, and locking means designed to engage with said stop region of said second wheel-and-pinion unit to prevent the latter from rotating between two successive movements of said indicator member, said first wheel-and-pinion unit further comprising a cam coaxial with and fixed to said first wheel and designed to act on said locking means, in each period, in order to release them momentarily and permit stealthy rotation of said second wheel-and-pinion unit through a predefined angle, under action of said elastic member, and said mechanism also comprising a retarding device acting on said second wheel-and-pinion unit in such a way as to limit its speed of stealthy rotation.

2. The timepiece movement according to claim 1, said elastic member being a spiral spring whose first end is attached to said first wheel-and-pinion unit while its second end is attached to said second wheel-and-pinion unit.

3. The timepiece movement according to claim 1, said second wheel-and-pinion unit comprising a drive wheel having a periphery in which said stop region is designed in the form of a notch, and said locking means comprising a first long spring with a free end designed to engage in said notch and lock it.

4. The timepiece movement according to claim 1, said free end of said long spring being in permanent contact with said periphery of said drive wheel to fulfill the function of said retarding device.

5. The timepiece movement according to claim 3, said locking means comprising a second long spring arranged in such a way that it has a free end situated in a position approximately diametrically opposed to the position of said free end of said first long spring with reference to said drive wheel, in contact with the latter.

6. The timepiece movement according to claim 5, said first and second long springs being arranged in such a way that, at every instant, at least one of their respective free ends is bearing against said periphery of said drive wheel.

7. The timepiece movement according to claim 3, said cam having a general shape of a disk of predefined radius, shorter than a radius of activation, defined between said second wheel-and-pinion unit axis of rotation and said notch bottom, said cam also comprising a nose situated at a distance from said axis of rotation greater than said radius of activation and designed to push said free end of said long spring or springs out of said locking means in each period.

8. The timepiece movement according to claim 1, said indicator member being connected to an indicator wheel, said second cinematic connection comprising a gear connecting said second wheel to said indicator wheel, and the latter elements being respectively numbered in such a way that said indicator member performs a half revolution in each of said stealthy rotational movements.

9. A timepiece comprising a movement according to claim 1.

10. A timepiece comprising a case containing a movement according to claim 8, in which said indicator member carries a sign designed to permit a distinction between respective states of rotation and immobility of said indicator member, said movement being surmounted by a dial comprising at least one window through which said sign can be made visible during each of said stealthy rotational movements.

11. The timepiece according to claim 10, said indicator wheel comprising a plate, said indicator member and at least said plate being made of one or more essentially transparent materials, preferably sapphire.

12. The timepiece according to claim 11, said indicator member and said indicator wheel being on top of a member for displaying the phases of the moon.

13. The timepiece movement according to claim 2, said second wheel-and-pinion unit comprising a drive wheel having a periphery in which said stop region is designed in the form of a notch, and said locking means comprising a first long spring with a free end designed to engage in said notch and lock it.

14. The timepiece movement according to claim 4, said cam having a general shape of a disk of predefined radius, shorter than a radius of activation, defined between said second wheel-and-pinion unit axis of rotation and said notch bottom, said cam also comprising a nose situated at a distance from said axis of rotation greater than said radius of activation and designed to push said free end of said long spring or springs out of said locking means in each period.

15. The timepiece movement according to claim 5, said cam having a general shape of a disk of predefined radius, shorter than a radius of activation, defined between said second wheel-and-pinion unit axis of rotation and said notch bottom, said cam also comprising a nose situated at a distance from said axis of rotation greater than said radius of activation and designed to push said free end of said long spring or springs out of said locking means in each period.

16. The timepiece movement according to claim 6, said cam having a general shape of a disk of predefined radius, shorter than a radius of activation, defined between said second wheel-and-pinion unit axis of rotation and said notch bottom, said cam also comprising a nose situated at a distance from said axis of rotation greater than said radius of activation and designed to push said free end of said long spring or springs out of said locking means in each period.

17. The timepiece movement according to claim 6, said indicator member being connected to an indicator wheel, said second cinematic connection comprising a gear connecting said second wheel to said indicator wheel, and the latter elements being respectively numbered in such a way that said indicator member performs a half revolution in each of said stealthy rotational movements.

18. A timepiece comprising a movement according to claim 3.

19. A timepiece comprising a movement according to claim 6.

20. A timepiece comprising a movement according to claim 8.

* * * * *